US005184371A

United States Patent [19]

Rands

[11] Patent Number: 5,184,371

[45] Date of Patent: Feb. 9, 1993

[54] VACUUM CLEANER ACCESSORY

[75] Inventor: Jerry W. Rands, Forest Lake, Minn.

[73] Assignee: North Country Products, Inc., Forest Lake, Minn.

[21] Appl. No.: 677,167

[22] Filed: Mar. 29, 1991

[51] Int. Cl.[5] ..... A47L 9/02; A47L 9/32

[52] U.S. Cl. ..... 15/325; 15/410; 15/414; 15/415.1

[58] Field of Search ..... 15/410, 415.1, 414, 15/325

[56] References Cited

U.S. PATENT DOCUMENTS

| | | | |
|---|---|---|---|
| 1,768,616 | 7/1930 | Lee | 15/414 |
| 2,056,850 | 10/1936 | Goughnour | 15/410 X |
| 2,101,222 | 12/1937 | McCracken | 15/414 X |
| 2,624,061 | 1/1953 | Leas | 15/414 X |
| 2,805,440 | 9/1957 | Hakanson | 15/414 X |

FOREIGN PATENT DOCUMENTS

| | | | |
|---|---|---|---|
| 642989 | 6/1962 | Canada | 15/414 |
| 58054 | 6/1937 | Norway | 15/325 |

*Primary Examiner*—Chris K. Moore

*Attorney, Agent, or Firm*—Merchant, Gould, Smith, Edell, Welter & Schmidt

[57] ABSTRACT

The present invention provides a vacuum cleaner accessory to be attached to a vacuum cleaner by means of a vacuum cleaner hose. In a first operative configuration, the accessory is designed to facilitate vacuuming of spaces that are accessible from any given direction. An upper tube member (20) is operatively connected at its upper end (22) to a vacuum cleaner hose (10), and at its lower end (23) to an elongate lower tube member (30). The elongate lower tube member (30) has a remote end (31) that defines a contoured intake opening (33) through which air, dust, water, and/or debris are suctioned. In a second operative configuration, the accessory is designed primarily to access floor level horizontally accessible spaces. A transverse sweeper member 60, which includes a downwardly facing transverse intake opening 66, is operatively connected to the remote end (31) of the lower tube member (30). A handle member (40), which is releasably secured to the upper tube member (20), extends approximately perpendicularly relative to the substantially horizontal surface (90) to be vacuumed.

10 Claims, 2 Drawing Sheets

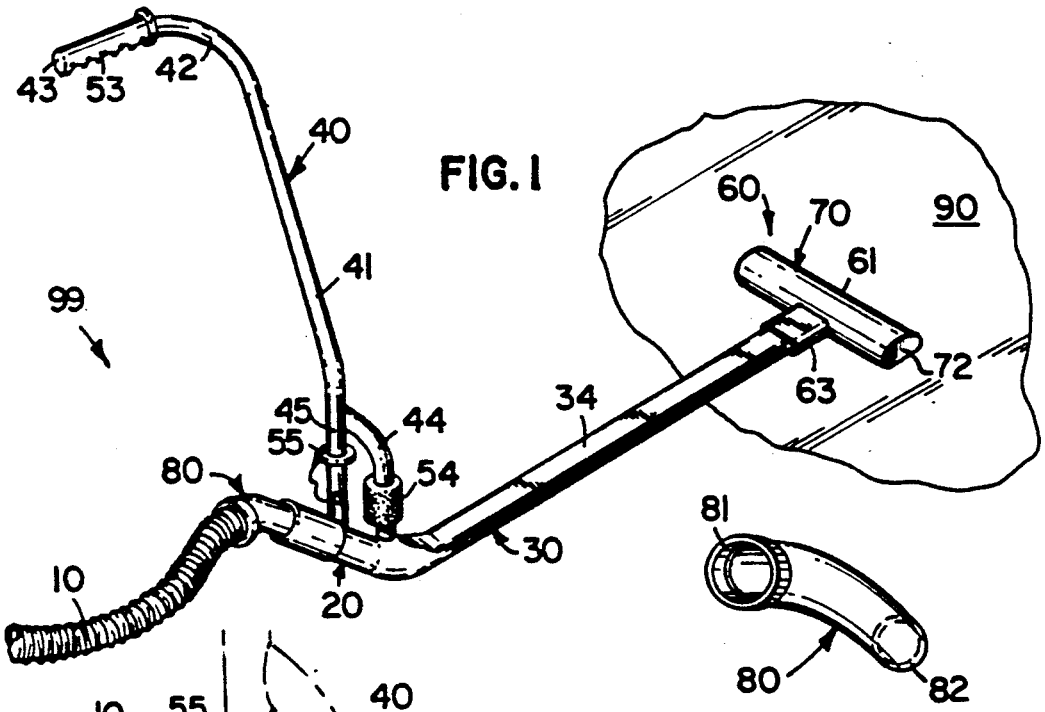
FIG. 1
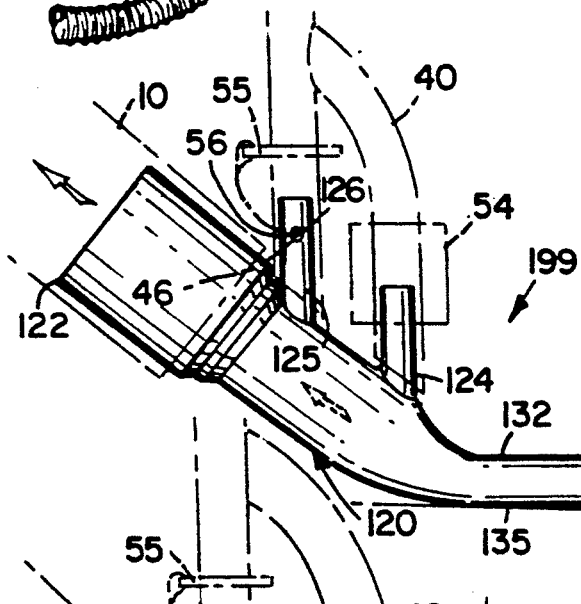
FIG. 2
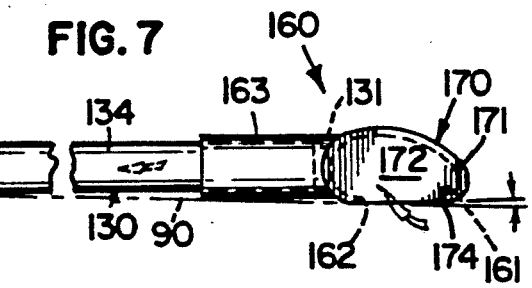
FIG. 7
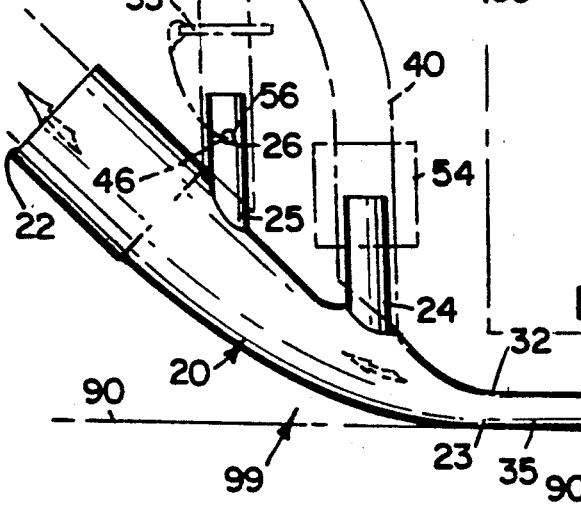
FIG. 3
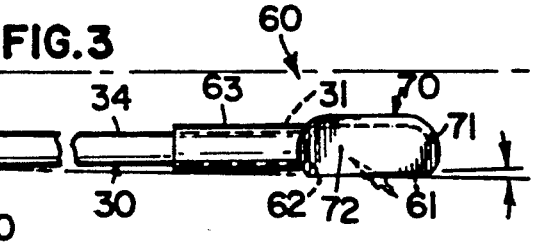

FIG.4
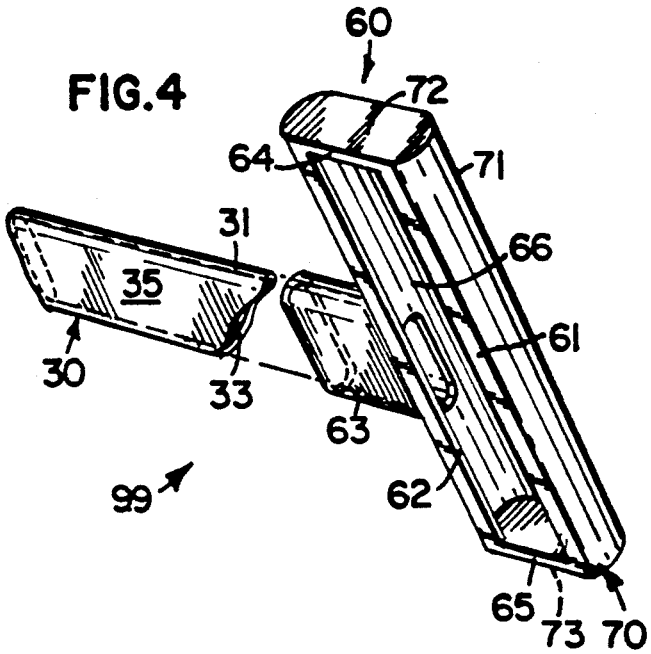
FIG.5
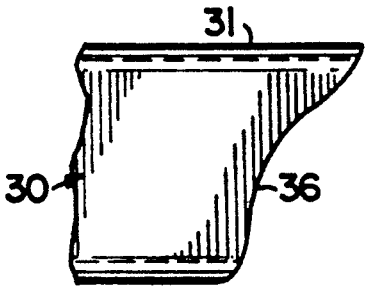
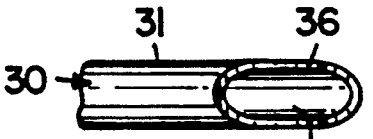
FIG.6
FIG. 10
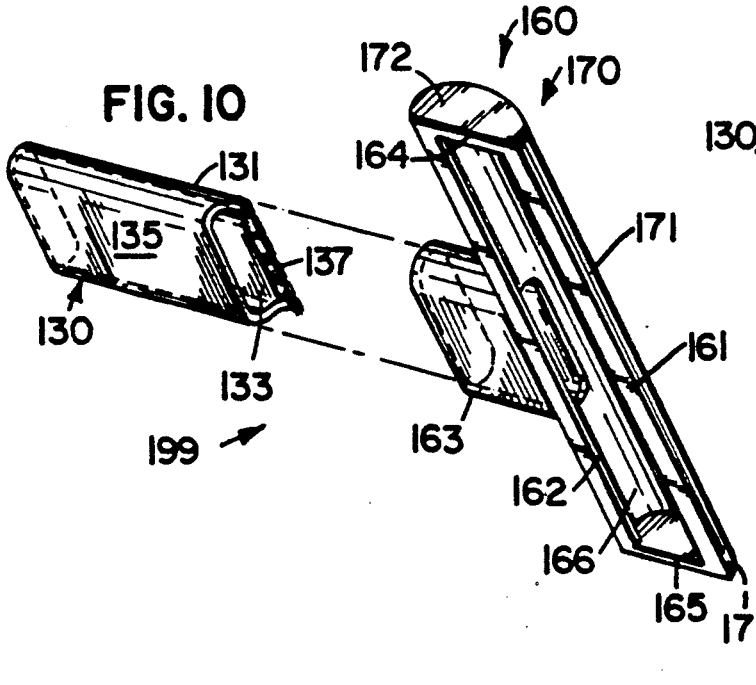
FIG. 8
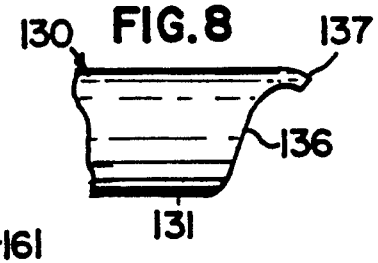
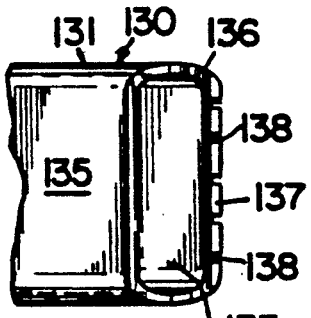
FIG. 9

VACUUM CLEANER ACCESSORY

FIELD OF THE INVENTION

The present invention relates generally to vacuum cleaner accessories, and more particularly, to a vacuum cleaner hose attachment for vacuuming otherwise obstructed areas.

BACKGROUND OF THE INVENTION

The effectiveness of any vacuum cleaner is a function of getting the suction from the vacuum to the surface to be cleaned. For example, when vacuuming a floor, one typically encounters numerous obstacles, usually in the form of furniture, which limit direct access to portions of the floor. In order to effectively vacuum these otherwise obstructed areas, one must either remove the obstacles or access these areas indirectly by means of vacuum cleaner attachments. Certain of these otherwise obstructed areas can be accessed vertically, as is the case with the space between a major household appliance and an adjacent wall. Other otherwise obstructed areas can be accessed horizontally, as is the case with the space beneath furniture such as sofa or bed. Also since dust and debris can accumulate almost anywhere, it is obviously desirable to be able to conveniently vacuum almost anywhere. In that regard, obstructed floor areas are not the only spaces that require frequent vacuuming but are not directly accessible. For example, dust collects on refrigerator coils and adversely affects the performance of the refrigerator.

Recognizing that vacuuming is and/or should be a relatively frequent household chore, and that frequent removal and return of furniture and other obstacles is a burdensome task, there have been previous attempts to develop a vacuum cleaner attachment that provides access to otherwise obstructed spaces.

For example, U.S. Pat. No. 4,694,529 to Choiniere discloses a vacuum cleaner extension device for vacuuming under household appliances and furniture having low ground clearance. The Choiniere device includes a socket portion that connects to a vacuum cleaner hose, and a slender, hollow blade portion connected thereto. An elongated aperture is formed in an offset portion of the bottom wall of the blade portion, and a transverse slit is formed in the front end of the blade portion.

U.S. Pat. No. 4,715,088 to Haase similarly discloses a vacuum cleaner attachment for vacuuming under household appliances and furniture having low ground clearance. The Haase device similarly includes a fitting that connects to a vacuum cleaner hose, and a slender, hollow body member connected thereto. Suction openings are formed in the side walls of the body member. Both of these devices are somewhat clumsy to use and also somewhat limited in their applications in part because they essentially are designed to operate laterally relative to their direction of insertion. Also, both devices rely, to some extent at least, on suction apertures that are not directed toward the surface to be vacuumed, thus limiting their effectiveness. Applicant's invention addresses these shortcomings and provides additional advantages, as will be discussed below.

U.S. Pat. No. 4,053,962 to McDowell discloses a vacuum cleaner attachment for vacuuming restricted access locations, such as refrigerator coils. The McDowell attachment includes tapered, stepped cavities that connect to a vacuum cleaner hose, and a slender tube portion connected thereto. At its outer working tip, the tube portion has an opening defining an angle between 20° and 60° relative to the tube portion's longitudinal axis. However, the opening is substantially flat, making the McDowell attachment unsuitable for vacuuming substantially flat surfaces because of the possibility that the attachment would "air-lock," as recognized by those skilled in the art. While these known attachments are rather limited in their uses, Applicant's invention can be used to vacuum all kinds of horizontally or vertically accessible spaces, including otherwise obstructed spaces such as refrigerator coils, by nature of the various operative configurations provided by Applicant's invention.

SUMMARY OF THE INVENTION

The present invention provides a vacuum cleaner accessory to be attached to a vacuum cleaner hose and used in conjunction with all types of vacuum cleaners, including dry and wet applications. According to a preferred embodiment, the vacuum cleaner accessory includes an upper tube member that is operatively connected to the vacuum cleaner hose, and an elongate lower tube member that is operatively connected at one end to the upper tube member. The elongate lower tube member also has a remote end that defines an intake opening through which air, dust, water, and/or debris are suctioned. Optimally, the lower tube member has a length of at least thirty-three (33) inches as measured between its connection with the upper tube member and the remote end, and it has a thickness of less than three-eighths ($\frac{3}{8}$) of an inch as measured between its top and bottom surfaces. The upper and lower tube members define a first operative configuration in which the vacuum cleaner accessory is capable of cleaning spaces that are accessible from any given direction.

In a first embodiment, an intake opening is cut with a concave contour across the top and bottom surfaces at a mean angle of between 30 and 70 degrees relative to the longitudinal axis of the lower tube member. In a second embodiment, the intake opening is cut with an S-shape profile from the top surface to the bottom surface at a mean angle of between 30 and 70 degrees relative to the longitudinal axis of the lower tube member. Also, at the top surface of the S-shape profile there are downwardly curved teeth extending from the top surface and defining gaps therebetween.

Either of the embodiments described above may be fitted with a transverse sweeper member that is operatively connected to the remote end of the lower tube member. The transverse sweeper member includes a housing having a lead edge, a trail edge, and opposite side edges, which define a downwardly facing intake opening therebetween. Either of the embodiments may additionally be fitted with a handle member, operatively connected at one end to the upper tube member. The handle member extends from the upper tube member in a direction substantially perpendicular to the lower tube member, and the handle member has a distal end that is designed for gripping by hand. The upper tube member, lower tube member, transverse sweeper member, and handle member define a second operative configuration in which the vacuum cleaner accessory is designed primarily for cleaning floor level, horizontally accessible, but otherwise obstructed spaces. The handle member of the second operative configuration may prove particularly useful to persons confined to a wheelchair or otherwise limited in their range of motion.

Applicant's invention is further distinguished by several additional features. For example, an elbowed coupling member can be optionally added between the vacuum cleaner hose and the upper tube member to direct the hose away from the area directly behind the accessory, where a person using the accessory would most likely stand. Also, a bumper member is provided on the handle member to prevent the handle member and/or the upper tube member from directly contacting and potentially damaging any furniture. Additionally, the lead and trail edges of the transverse sweeper member are tapered to fine tips that are designed to scrape debris from the surface being vacuumed. Further, a pair of sleeve members on the handle member slide onto a pair of posts on the upper tube member and are releasably secured thereto by a detent pin. This means of using dual posts to releasably secure the handle member to the upper tube member prevents the accessory from twisting during operation.

While the invention will be described with respect to a preferred embodiment, it will be understood that the invention is not limited to such design, but that the general principles of the invention apply to any and all designs. Further, the invention is not limited to any of the specifics of construction, other than as described within the appended claims. These and other variations of the invention will become apparent to those skilled in the art upon a more detailed description of the invention.

BRIEF DESCRIPTION OF THE DRAWING

FIG. 1 is a perspective view of a preferred embodiment of a vacuum cleaner accessory constructed according to the principles of the present invention;

FIG. 2 is a perspective view of the angled coupling member from the preferred embodiment of FIG. 1;

FIG. 3 is a side view of the preferred embodiment of FIG. 1;

FIG. 4 is a perspective view of the transverse sweeper member and the lower tube member from the preferred embodiment of FIG. 1;

FIG. 5 is a bottom view of the intake opening for the lower tube member from the preferred embodiment of FIG. 1;

FIG. 6 is a side view of the intake opening of FIG. 5;

FIG. 7 is a side view of another preferred embodiment of a vacuum cleaner accessory constructed according to the principles of the present invention;

FIG. 8 is a side view of the intake opening for the lower tube member from the preferred embodiment of FIG. 7;

FIG. 9 is a bottom view of the intake opening of FIG. 8; and

FIG. 10 is a perspective view of the transverse sweeper member and the lower tube member from the preferred embodiment of FIG. 7;

DETAILED DESCRIPTION OF THE INVENTION

Referring to the Figures, wherein like numerals represent like parts throughout the several views, a preferred embodiment of Applicant's vacuum cleaner hose attachment 99 is shown in FIG. 1. The attachment 99 generally comprises an upper tube member 20, a lower tube member 30, a handle member 40, and a transverse sweeper member 60. A vacuum cleaner hose 10 is in fluid communication with a vacuum cleaner (not shown) that is known in the art and not necessarily limited to wet or dry applications. The upper tube member 20 is releasably secured to and in fluid communication with the vacuum cleaner hose 10, either directly (not shown) or by way of an elbowed coupling member 80, which is shown in greater detail in FIG. 2. The vacuum cleaner hose 10 is releasably secured by friction fit to a hose end 81 of the elbowed coupling member 80, and an accessory end 82 of the elbowed coupling member 80 is releasably secured by friction fit to an upper end 22 of the upper tube member 20. Those skilled in the art will recognize that there are other means available, such as snap buttons, for releasably securing these parts together. By means of the friction fit connections, the upper tube member 20 may be said to be in fluid communication with the vacuum cleaner hose 10.

The hose end 81 and the accessory end 82 of the elbow coupling member 80 define an angle of approximately 120 degrees therebetween. This angle could vary by at least 30 degrees either way and not significantly detract from the intended purpose of the elbowed coupling member 80, which is to divert the vacuum cleaner hose 10 away from the area directly behind the vacuum cleaner accessory 99, so that an individual using the accessory 99 can conveniently stand behind the accessory 99 and hold a hand grip 53 in one hand and the vacuum cleaner hose 10 in the other.

The upper tube member 20 is a hollow, substantially cylindrical body extending from the upper end 22 to a lower end 23. The lower tube member 30 is a hollow, elongate body extending from a first (remote) end 31 to a second end 32 and defining a longitudinal axis. The lower tube member 30 has an optimum length of thirty-three (33) inches and an optimum height of three-eighths ($\frac{3}{8}$) of an inch, as measured between top and bottom surfaces 34 and 35. The second end 32 of the lower tube member 30 integrally joins the lower end 23 of the upper tube member 20, such that the upper tube member 20 and the lower tube member 30 are in fluid communication with one another. The first (remote) end 31 of the lower tube member 30 defines an intake opening 33, through which air, dust, water and/or debris are suctioned, as will be further discussed below. The upper and lower tube members 20 and 30, as well as the elbowed coupling member 80 and the transverse sweeper member 60, are made from a substantially rigid plastic material. Those skilled in the art will recognize that these parts may be manufactured in various manners and from other available materials.

Referring to FIGS. 4 through 6, the specific configuration of the intake opening 33 at the remote end 31 of the lower tube member 30 is shown in greater detail. The intake opening 33 is cut with a concave contour 36 across the top and bottom surfaces 34 and 35, at a mean angle of approximately 50 degrees relative to the longitudinal axis of the lower tube member 30. Those skilled in the art will recognize that this angle may vary significantly (at least 20 degrees either way) without adversely affecting the utility of Applicant's invention. The angle of the cut of the intake opening 33 provides an area of suction greater than the cross-section of the lower tube member 30. Also, it facilitates use of the accessory with the lower tube member 30 at an angle of approximately 50 degrees relative to the surface being vacuumed, which angle is deemed to be particularly convenient. The concave contour 36 effectively eliminates the possibility that the intake opening 33 will "air-lock" against a substantially flat surface.

A hollow collar member 63 on the transverse sweeper member 60 is releasably secured by friction fit to the first (remote) end 31 of the lower tube member 30 such that the transverse sweeper member 60 and the lower tube member 30 are in fluid communication with one another. In addition to the collar member 63, the transverse sweeper member 60 includes a housing 70, which is defined by a rounded top member 71 and opposing side members 72 and 73. The housing 70 has an operative height of five-eighths ($\frac{5}{8}$) of an inch to allow access to low clearance, horizontally accessible spaces. Also, the rounded profile of the top member 71 minimizes the possibility that the transverse sweeper member 60 will snag or catch when being used on carpet.

The housing 70 of the transverse sweeper member 60 is bordered by lead and trail edges 61 and 62, as well as opposing side edges 64 and 65, which define a downwardly facing transverse intake opening 66. The lead and trail edges 61 and 62 are designed to have fine tips to scrape debris from the substantially flat surface 90 to be vacuumed. As shown in FIG. 3, the relative positions of the lead and trail edges 61 and 62 is such that in operation, the trail edge 62 rests squarely against the substantially flat surface 90, together with the second end 32 of the lower tube member 30, and the lead edge 61 is offset a small distance from the surface 90. In operation, this inclination of the lead edge 61 relative to the trail edge 62 allows suction through the foremost portion of the accessory and also reduces the likelihood of "air-lock."

Referring to FIG. 1, the handle member 40 is releasably secured at one end to the upper tube member 20, by means of first and second sleeve members 44 and 45, which slidably engage first and second post members 24 and 25 on the upper tube member 20. A detent pin 56, which is tethered to a ring 55 on the second sleeve member 45, passes through holes 26 and 46 formed in the second post member 25 and second sleeve member 45, respectively, to releasably secure the handle member 40 to the upper tube member 20. Those skilled in the art will recognize that other means, such as snap buttons, are available to make this connection. The dual post configuration greatly reduces the chances of the accessory 99 twisting during operation.

The sleeve members 44 and 45 of the handle member 40 integrally join an extension member 41, which in turn, integrally joins a curved portion 42. The handle member 40 extends from its point of connection with the upper tube member 20 to a distal end 43, where it is fitted with a hand grip 53. The extension member 41 extends in a direction substantially perpendicular to the lower tube member 30, and the curved portion 42 is configured so that the hand grip 53 is substantially parallel to the lower tube member 30. The handle member 40 may prove particularly useful to persons confined to a wheelchair or otherwise having limited mobility. Also, a bumper guard 54 is secured to the first sleeve member 44 to prevent the upper tube member 20 and the handle member 40 from directly contacting and possibly damaging furniture 91 or the like. The bumper guard 54 is ideally made from a dense foam material, though those skilled in the art will recognize that other suitable materials are available.

In a first operative configuration, the upper and lower tube members 20 and 30 are releasably secured to and in fluid communication with the vacuum cleaner hose 10, forming a sort of crevice tool, as that term is recognized by those skilled in the art. This crevice tool configuration allows a person to vacuum any space that is accessible in at least one given direction, and it is particularly well-suited for vacuuming refrigerator coils, heating and air conditioning units, and vertically or horizontally accessible spaces, such as those spaces between a major household appliance and an adjacent wall or those spaces underneath a major household appliance. In a second operative configuration, the handle member 40 and the transverse sweeper member 60 are added to the accessory in order to adapt the invention primarily for vacuuming low clearance, horizontally accessible floor spaces. The dimensions of the lower tube member 30 and the transverse sweeper member 60 are such that the attachment facilitates vacuuming underneath furniture such as sofas and beds.

The embodiment 99 shown in FIGS. 1 through 6 is designed particularly for household use in connection with a standard household vacuum cleaner, though it need not be limited to such applications. On the other hand, the embodiment 199 shown in FIGS. 7 through 10 is designed primarily for industrial shop use, though again, it need not be limited to such application. Although the two embodiments 99 and 199 are similar in several respects, to the extent that there are differences between these two embodiments 99 and 199, it is believed that these differences make the embodiments especially well-suited for their intended environments. For example, the rounded top member 71 of the first embodiment 99 is designed to minimize snagging or catching on carpet.

A second preferred embodiment of Applicant's vacuum cleaner hose attachment 199 is shown in FIG. 7. The attachment 199 similarly generally comprises an upper tube member 120, a lower tube member 130, a handle member 140, and a transverse sweeper member 160. The upper tube member 20 is releasably secured to and in fluid communication with a vacuum cleaner hose 10, either directly or by way of an elbowed coupling member (similar to that shown in FIG. 2). The vacuum cleaner hose 10 is releasably secured by friction fit to an upper end 122 of the upper tube member 120. Those skilled in the art will recognize that there are other means available, such as snap buttons, for releasably securing these parts together. By means of the friction fit connection, the upper tube member 120 may be said to be in fluid communication with the vacuum cleaner hose 10, which in turn, is in fluid communication with a vacuum cleaner.

The upper tube member 120 is a hollow, substantially cylindrical body extending from the upper end 122 to a lower end 123. The lower tube member 130 is a hollow, elongate body extending from a first (remote) end 131 to a second end 132 and defining a longitudinal axis. The lower tube member 130 has an optimum length of thirty-three (33) inches, as measured between the first end 131 and the second end 132, and an optimum height of three-quarters ($\frac{3}{4}$) of an inch, as measured between top and bottom surfaces 134 and 155. The second end 132 of the lower tube member 130 integrally joins the lower end 123 of the upper tube member 120, such that the upper tube member 120 and the lower tube member 130 are in fluid communication with one another. The first (remote) end 131 of the lower tube member 130 defines an intake opening 133, through which air, dust, water, and/or debris are suctioned, as will be further discussed below. The upper and lower tube members 120 and 130, as well as the elbowed coupling member (not shown) and the transverse sweeper member 160, are made from a substantially rigid plastic material. Those skilled in the art will recognize that these parts may be manufactured in various manners from other available materials.

Referring to FIGS. 8 through 10, the specific configuration of the intake opening 133 at the remote end 131 of the lower tube member 130 is shown in greater detail. The intake opening 133 is cut with an S-shaped contour 136 across the top and bottom surfaces 134 and 135 at a mean angle of approximately 50 degrees relative to the longitudinal axis of the lower tube member 130. Those skilled in the art will recognize that this angle may vary significantly (at least 20 degrees either way) without adversely affecting the utility of Applicant's invention. Downwardly curved teeth 137 extend from the top surface 134 of the S-shaped contour 136, and the teeth 137 define gaps 138 therebetween.

The angle of the cut of the intake opening 133 provides an area of suction greater than the cross-section of the lower tube member 130. Also, it facilitates use of the accessory with the lower tube member 130 at an angle of approximately 50 degrees relative to the surface being vacuumed, which angle is deemed to be particularly convenient. The S-shaped contour 136 effectively eliminates the possibility that the intake opening 133 will "air-lock" against a substantially flat surface. In operation, the configuration of the intake opening has been particularly effective, as the downwardly curved teeth 137 direct the suction downward, while he gaps 138 allow suction through the foremost portion of the accessory.

A hollow collar member 163 on the transverse sweeper member 160 is releasably secured by friction fit to the first (remote) end 131 of the lower tube member 130 such that the transverse sweeper member 160 and the lower tube member 130 are in fluid communication with one another. In addition to the collar member 163, the transverse sweeper member 160 includes a housing 170, which is defined by a top member 171 and opposing side members 172 and 173. The housing 170 has an operative height of less than one inch to allow access to low clearance, horizontally accessible spaces.

The housing 170 of the transverse sweeper member 160 is bordered by lead and trail edges 161 and 162, as well as opposing side edges 164 and 165, which define a downwardly facing transverse intake opening 166. The lead and trail edges 161 and 162 are designed to have fine tips to scrape debris from the substantially flat surface 90 to be vacuumed. As shown in FIG. 7, the relative positions of the lead and trail edges 161 and 162 is such that in operation, the trail edge 162 rests squarely against the substantially flat surface 90, together with the second end 132 of the lower tube member 130, and the lead edge 161 is offset a small distance from the surface 90. In operation, this inclination of the lead edge 161 relative to the trail edge 162 allows suction through the foremost portion of the accessory and also reduces the likelihood of "air-lock."

While the specific embodiments of the invention have been disclosed, it is to be understood that such disclosure has been merely for the purpose of illustration and that the invention is not to be limited in any manner thereby. Various modifications of this invention will be apparent to those skilled in the art in view of the foregoing example. The scope of the invention is to be limited only by the appended claims.

What is claimed is:

1. A vacuum cleaner accessory, of a type that attached to a vacuum cleaner by means of a vacuum cleaner hose, comprising:

(a) an elongate lower tube member having first and second ends, wherein said first end defines an intake opening, said intake opening of said lower tube member being cut at an angle of between 30° and 70° relative to said lower tube member's longitudinal axis, and said intake opening has a concave profile;

(b) an upper tube member having lower and upper ends, wherein said lower end of said second end of said lower tube member, and said upper end is in fluid communication with the vacuum cleaner hose, wherein said lower tube member and said upper tube member define a first operative configuration in which the vacuum cleaner accessory is designed for cleaning spaces that are accessible from a desired direction;

(c) a handle member releasably secured at one end to said upper tube member and extending in a first direction substantially perpendicular to said lower tube member, wherein said handle member has a distal end for gripping by hand; and (d) a sweeper member releasably secured to and in fluid communication with said first end of said lower tube member, wherein said sweeper member includes a housing having a leading edge, a trailing edge, and opposite side edges, defining a downwardly facing intake opening therebetween, wherein said lower tube member, said upper tube member, said handle member, and said sweeper member define a second operative configuration in which the vacuum cleaner accessory is designed primarily for cleaning floor level, horizontally accessible spaces.

2. A vacuum cleaner accessory, of a type that attaches to a vacuum cleaner by means of a vacuum cleaner hose, comprising:

(a) an elongate lower tube member having first and second ends, wherein said first end defines an intake opening, said intake opening of said lower tube member being cut at an angle between 30° and 70° relative to said lower tube member's longitudinal axis, and said intake opening has an S-shaped profile;

(b) an upper tube member having lower and upper ends, wherein said lower end of said second end of said lower tube member, and said upper end is in fluid communication with the vacuum cleaner hose, wherein said lower tube member and said upper tube member define a first operative configuration in which the vacuum cleaner accessory is designed for cleaning spaces that are accessible from a desired location;

(c) a handle member releasably secured at one end to said upper tube member and extending in a first direction substantially perpendicular to said lower tube member, wherein said handle member has a distal end for gripping by hand; and (d) a sweeper member releasably secured to and in fluid communication with said first end of said lower tube member, wherein said sweeper member includes a housing having a leading edge, a trailing edge, and opposite side edges, defining a downwardly facing intake opening therebetween, wherein said lower tube member, said upper tube member, said handle member, and said sweeper member define a second operative configuration in which the vacuum cleaner accessory is designed primarily for cleaning floor level, horizontally accessible spaces.

3. A vacuum cleaner accessory according to claim 2, wherein said S-shaped profile includes downwardly curved teeth extending from a top surface of said lower tube member and defining gaps therebetween.

4. A vacuum cleaner accessory, of a type that attaches to a vacuum cleaner by means of a vacuum cleaner hose, comprising:

(a) an elongate lower tube member having first and second ends, wherein said first end defines an intake opening;

(b) an upper tube member having lower and upper ends, wherein said lower end of said second end of said lower tube member, and said upper end is in fluid communication with the vacuum cleaner hose, wherein said lower tube member and said upper tube member define a first operative configuration in which the vacuum cleaner accessory is designed for cleaning spaces that are accessible from a desired direction;

(c) a handle member releasably secured at one end to said upper tube member and extending in a first direction substantially perpendicular to said lower tube member, wherein said handle member has a distal end for gripping by hand; and (d) a sweeper member releasably secured to and in fluid communication with said first end of said lower tube member, wherein said sweeper member includes a housing having a leading edge, a trailing edge, and opposite side edges, defining a downwardly facing intake opening therebetween, said leading and trailing edges of said sweeper member being tapered to have fine tips to scrape debris from a substantially flat surface, wherein said lower tube member, said upper tube member, said handle member, and said sweeper member define a second operative configuration in which the vacuum cleaner accessory is designed primarily for cleaning floor level, horizontally accessible spaces.

5. A vacuum cleaner accessory, of a type that attaches to a vacuum cleaner by means of a vacuum cleaner hose, comprising:

(a) an elongate lower tube member having first and second ends, wherein said first end defines an intake opening;

(b) an upper tube member having lower and upper ends, wherein said lower end of said second end of said lower tube member, and said upper end is in fluid communication with the vacuum cleaner hose, wherein said lower tube member and said upper tube member define a first operative configuration in which the vacuum cleaner accessory is designed for cleaning spaces that are accessible from a desired direction, said upper tube member including first and second posts, and said one end of said handle member including first and second sleeve members, and said first and second sleeve members slidably engage said first and second posts, respectively, to releasably secure said handle member to said upper tube member;

(c) a handle member releasably secured at one end to said upper tube member and extending in a first direction substantially perpendicular to said lower tube member, wherein said handle member has a distal end for gripping by hand; and (d) a sweeper member releasably secured to and in fluid communication with said first end of said lower tube member, wherein said sweeper member includes a housing having a leading edge, a trailing edge, and opposite side edges, defining a downwardly facing intake opening therebetween, wherein said lower tube member, said upper tube member, said handle member, and said sweeper member define a second operative configuration in which the vacuum cleaner accessory is designed primarily for cleaning floor level, horizontally accessible spaces.

6. A vacuum cleaner accessory according to claim 5, wherein said first post and said first sleeve member are closer to said lower tube member than are said second post and said second sleeve member, and a bumper member is positioned on said first sleeve member.

7. A vacuum cleaner accessory according to claim 6, wherein a detent pin is tethered to said handle member, and said detent pin is releasably secured in holes formed in said second sleeve member and said second post.

8. A vacuum cleaner accessory, of a type that attaches to a vacuum cleaner by means of a vacuum cleaner hose, comprising:

(a) an upper tube member in fluid communication with the vacuum cleaner hose; and (b) an elongate lower tube member in fluid communication with said upper tube member and having a remote end defining an intake opening, wherein said lower tube member has a length of at least thirty-three (33) inches as measured between said upper tube member and said remote end, and said lower tube member has a thickness of approximately three-quarters ($\frac{3}{4}$) of an inch as measured between top and bottom surfaces thereof, and said intake opening is cut with an S-shape profile from said top surface to said bottom surface at a mean angle of between 30 and 70 degrees relative to said length.

9. A vacuum cleaner accessory according to claim 8, wherein downwardly curved teeth extend from said top surface at said intake opening, and said teeth define gaps therebetween.

10. A vacuum cleaner accessory according to claim 8, further comprising a transverse sweeper member releasably secured to and in fluid communication with said remote end of said lower tube member, wherein said transverse sweeper member includes a housing having a lead edge, a trail edge, and opposite side edges, defining a downwardly facing intake opening therebetween.

* * * * *